US005977541A

United States Patent [19]

Miyazawa et al.

[11] Patent Number: 5,977,541

[45] Date of Patent: Nov. 2, 1999

[54] LASER IONIZATION MASS SPECTROSCOPE AND MASS SPECTROMETRIC ANALYSIS METHOD

[75] Inventors: Kunio Miyazawa, Tokyo; Totaro Imasaka, Fukuoka; Hitoshi Miyamoto, Tokyo, all of Japan

[73] Assignee: NKK Corporation, Tokyo, Japan

[21] Appl. No.: 09/065,089

[22] PCT Filed: Aug. 29, 1997

[86] PCT No.: PCT/JP97/03029

§ 371 Date: Aug. 18, 1998

§ 102(e) Date: Aug. 18, 1998

[87] PCT Pub. No.: WO98/09316

PCT Pub. Date: Mar. 5, 1998

[30] Foreign Application Priority Data

| | | | |
|---|---|---|---|
| Aug. 29, 1996 | [JP] | Japan | 8/228283 |
| Aug. 29, 1996 | [JP] | Japan | 8/228284 |
| Aug. 30, 1996 | [JP] | Japan | 8/230866 |
| Aug. 30, 1996 | [JP] | Japan | 8/230867 |

[51] Int. Cl.[6] ..... H01J 49/10

[52] U.S. Cl. ..... 250/288; 250/423 P

[58] Field of Search ..... 250/288, 281, 250/282, 423 P, 423 R, 424

[56] References Cited

U.S. PATENT DOCUMENTS 5,382,794 1/1995 Downey et al. ..... 250/288

*Primary Examiner*—Kiet T. Nguyen

*Attorney, Agent, or Firm*—Flynn, Thiel, Boutell & Tanis, P.C.

[57] ABSTRACT

The present invention provides a laser ionization mass spectrometric apparatus comprising a sample introducing portion provided with a pulse valve which forms molecular jet, a pulsed laser beam oscillator, a vacuum ionization chamber or a corresponding portion thereto having a window capable of passing the laser beam radiated from the oscillator, and a mass spectrometer which analyzes the mass of molecules ionized by the laser beam, wherein said pulse laser oscillator has an ability of oscillating ultrashort pulsed laser beam having a peak output of 1 MW or more. The laser ionization mass spectrometric apparatus can use a turbomolecular vacuum pump to evacuate the above vacuum ionization chamber and the above sample introducing portion can comprise two or more pinhole nozzles. The laser ionization mass spectrometric apparatus can have the above slit nozzle partitioned from the vacuum ionization chamber by a slit skimmer which inhibits a stream of molecules on the periphery of the molecular jet from entering the vacuum ionization chamber. The apparatus of the invention has a high sensitivity and high accuracy, and is rendered compact. Accordingly, the apparatus exercises its power in the rapid analysis of combustion exhaust gases and the like.

7 Claims, 10 Drawing Sheets

LASER IONIZATION MASS SPECTROSCOPE AND MASS SPECTROMETRIC ANALYSIS METHOD

TECHNICAL FIELD

This invention relates to a laser ionization mass spectrometric technique for conducting mass spectrometric analysis of a sample to be measured by ionizing the sample molecule by laser beam irradiation, and measuring mass spectra of the ion.

BACKGROUND ART

Combustion exhaust gases of coal, heavy oil, etc., combustion exhaust gases of municipal waste or industrial waste, gases generated by the pyrolysis of plastics and so on contain various compounds, such as nitrogen oxides, sulfur oxides, aromatic compounds, chlorine-containing organic compounds, chlorinated aromatic compounds and other halogen-containing compounds, although their contents are minor. In many cases, two or more of them coexist, i.e. exist in a mixed state. As a rapid measurement technique of these compounds, there is a method of laser multiphoton ionization mass spectrometry which has detection selectivity of the compounds to be measured.

An example of the technique for measuring a mixed gaseous sample by laser multiphoton ionization mass spectrometry is disclosed in Analytical Chemistry, vol. 66, pp 1062–1069, 1994. That is, according to the laser multiphoton ionization mass spectrometry having a conventional sample introduction system, peaks corresponding to each compound overlap with each other due to broad peaks, and therefore, quantitative analysis is difficult. Thereupon, a gaseous sample is introduced into a vacuum ionization chamber through a sample inlet valve having a small bore diameter. The gaseous sample is ionized by irradiating a laser beam, and measured by a mass spectrometer. At that time, since the gaseous sample is cooled to near zero degree of absolute temperature by adiabatic expansion, vibration and rotation of the molecules of each compound are inhibited. Accordingly, peaks corresponding to each compound are rendered sharp and separated from each other, resulting in the facilitation of quantitative analysis. Since the speed of the introduced molecules is about tens of times as much as sonic velocity, this method is also called supersonic molecular beam spectroscopy or supersonic molecular jet spectroscopy. In the document, it is described that a standard laser beam irradiation time is 10 ns.

In the sample introduction in the supersonic molecular jet, in general, there is a restriction of the introduction amount per unit time of a gaseous sample introduced continuously or intermittently in order to maintain high vacuum conditions of the ionization chamber. As a result, it is a problem that sensitivity on the whole is lowered due to a very small amount of sample to be measured. As a countermeasure, it has been considered to increase the laser beam irradiation energy.

However, when the laser beam energy is increased, a problem occurs that accurate determination cannot be made because of decomposition, i.e. fragmentation, of the molecules to be measured.

Another countermeasure against the above sensitivity reduction caused by minor amount of measuring objects, there is a method of introducing a sample at a laser beam passage by using a slit-shaped nozzle, as disclosed in Review Science Instrumentation, vol. 67, pp 410–416, 1996. In the method, the laser beam is irradiated perpendicular to a molecular jet jetted planar on the same plane, and thereby, the interacting space between molecules and laser beam increases to increase the production of ions.

Although this method is effective, however, in principle, ions are produced and exist in the space in proportion to the size of the slit opening and the diameter (size) of the irradiating laser beam. That is, to enlarge the slit opening relates to the space distribution of molecular ions being delivered in a mass spectrometer, and it does not contribute to the increase of signal/noise ratio (S/N ratio) by a portion in proportion to ion production. Moreover, the load on the exhaust system must be considered, and accordingly, the slit opening cannot be enlarged to an extreme. That is, only the central portion along the major axis of the slit opening contributes to the signal, and molecules existing on the periphery do not contribute to the signal, and, nevertheless, lower the degree of vacuum. Furthermore, since the cooling of the molecular jet is inferior, there is a possibility to lower the S/N ratio conversely. These matters are also problems induced by enlarging an opening for the purpose of introducing a sample in quantity, not only in a slit nozzle but also in a pinhole nozzle.

Accordingly, unless the sample flow is increased, the sensitivity cannot be improved. If sample flow is increased, it lowers the degree of vacuum of the mass spectrometer at a later stage to stop the mass spectrometer by working a safeguard for apparatus protection. This problem is especially remarkable when a measurement is conducted near full capacity of the exhaust system with pulse injection of a sample which brings a great pressure variation, in order to improve sensitivity.

On the other hand, in order to make the supersonic molecular jet, an ionization chamber, related portions thereto, and so on must be made in high vacuum conditions, and in general, a diffusion pump, i.e. oil diffusion pump, is frequently used for the exhaust system, as disclosed in Ed. by The Chemical Society of Japan, "Jikken Kagaku Koza", 4th Ed., vol. 8, p119, 1993.

An oil rotary pump or the like or a combination of both pumps are also used. The exhaust velocity of an oil diffusion pump and an oil rotary pump is, in general, high, i.e. high vacuum conditions can be maintained. However, the oil used in the pumps exists in the ionization chamber, although the amount is very small. As a result, it is a problem that the oil is ionized as it is or ionized through a decomposition reaction, by the irradiation of pulsed laser beam, and causes an increase in background noise.

An object of the invention is, in a laser multiphoton ionization mass spectrometry technique with a sample introducing system by a supersonic molecular jet, to provide an apparatus and a method capable of detecting in high sensitivity and measuring stably.

Another object of the invention is to provide an apparatus, although intending to introduce a sample in quantity, capable of detecting in high sensitivity by not lowering a S/N ratio.

Still another object of the invention is, in a laser multiphoton ionization mass spectrometry technique with a sample introducing system by supersonic molecular jet, to provide a measuring apparatus which lowers background noise and thereby increases signal strength.

DISCLOSURE OF INVENTION

The inventors investigated earnestly, and as a result, they found that, although fragmentation of molecules depends on the energy of an irradiating laser beam, ionization of molecules relates to the peak output of the laser beam. It was found that, when an ultrashort pulsed laser beam having a great peak output is irradiating, unless the laser beam energy increases beyond a critical energy where fragmentation of molecules occurs, ionization efficiency can be improved. That is, by using laser beam having a great peak output, molecular ion production can be increased while inhibiting fragmentation of molecules.

Accordingly, the aforementioned problems are solved by a laser ionization mass spectrometric apparatus comprising a sample introducing portion provided with a pulse valve which forms a molecular jet, a pulsed laser beam oscillator, a vacuum ionization chamber or a corresponding portion thereto having a window capable of passing the laser beam radiated from the oscillator, and a mass spectrometer which analyzes the mass of molecules ionized by the laser beam, wherein said pulse laser oscillator has an ability of oscillating an ultrashort pulsed laser beam having a peak output of 1 MW or more.

Moreover, they are solved by a mass spectrometry method which comprises forming a pulsed molecular jet by injecting a sample gas through a pulse valve capable of forming a molecular jet into a vacuum ionization chamber or a corresponding portion thereto, irradiating an ultrashort pulsed laser beam having a peak output of 1 MW or more onto the molecular jet to ionize it, and analyzing the mass of the molecules ionized by the laser beam.

The aforementioned problems are also solved by a laser ionization mass spectrometric apparatus comprising sample introducing portion provided with a nozzle which forms a molecular jet, a pulsed laser beam oscillator, a vacuum ionization chamber or a corresponding portion thereto having a window capable of passing the laser beam radiated from the oscillator, and a mass spectrometer which analyzes the mass of the molecules ionized by the laser beam, wherein said nozzle of the sample introducing portion comprises two or more pinhole nozzles.

The inventions also found that, the central portion of molecular jet contributes to the signal (improvement in sensitivity) upon ionization because of having a directional property and a uniform flow of molecules, but peripheral molecules do not contribute to the signal because of their small directional property. Thereupon, when a sample is introduced in quantity, a load on the exhaust system of a mass spectrometer can be decreased by removing the peripheral molecules by a skimmer so as not to be delivered to the mass spectrometer.

Accordingly, the aforementioned problems are solved by a laser ionization mass spectrometric apparatus comprising a sample introducing portion provided with a slit nozzle which forms a molecular jet, a pulsed laser beam oscillator, a vacuum ionization chamber or a corresponding portion thereto having a window capable of passing the laser beam radiated from the oscillator, and a mass spectrometer which analyzes the mass of molecules ionized by the laser beam, wherein said slit nozzle is partitioned from the vacuum ionization chamber by a slit skimmer which inhibits the stream of molecules on the periphery of the molecular jet from entering the vacuum ionization chamber.

Incidentally, the exhaust velocity of an oil-free turbo-molecular pump is, in general, low. Accordingly, when continuous measurement is carried out using only this type of pump, a small amount of the previous sample remains in an ionization chamber. As a result, there is a problem that the sample and/or decomposition product thereof are ionized and detected, which elevates the background noise. The inventors also succeeded in decreasing the background noise by using a pulse valve having a short working time as a sample introducing means in addition to the turbo-molecular pump so as to accommodate the introduced sample amount to the capacity of the turbo-molecular pump.

Accordingly, the aforementioned problems are solved by a laser ionization mass spectrometric apparatus comprising a sample introducing portion provided with a pulse valve which forms a molecular jet, a pulsed laser beam oscillator, a vacuum ionization chamber or a corresponding portion thereto having a window capable of passing the laser beam radiated from the oscillator, and a mass spectrometer which analyzes the mass of the molecules ionized by the laser beam, wherein a turbo-molecular vacuum pump is used as a pump which evacuates said vacuum ionization chamber.

1. Sample introducing portion

11 . . . Pulse valve

12 . . . Nozzle

13 . . Molecular jet

14 . . . Skimmer

15 . . . Hole portion

16 . . . Molecular jet

17 . . . Front chamber

18 . . . Slit

2. Pulsed laser beam oscillator

21 . . . Lens

Figure 1:
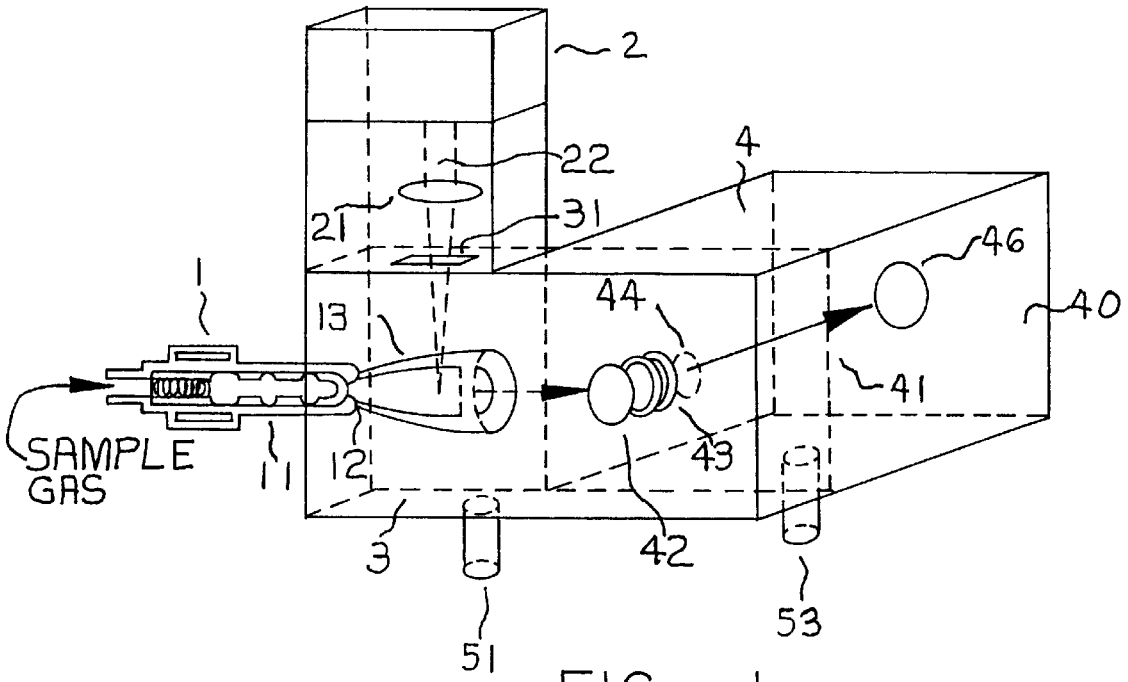
FIG. 1 is a drawing illustrating the construction of an apparatus which is an example of the invention.

22 . . . Pulsed laser beam

3. Vacuum ionization chamber

31 . . . Window

4. Mass spectrometer

40 . . . Vacuum chamber

41 . . . Partition wall

42 . . . Repeller electrode

43 . . . Accelerating electrode

44 . . . Ion passing hole

45 . . . Ion reflector

46 . . . Detector

51 . . . Exhaust system (oil diffusion pump, oil rotary pump or turbo-molecular pump)

52 . . . Exhaust system (oil diffusion pump, oil rotary pump or turbo-molecular pump)

53 . . . Exhaust system (turbo-molecular pump)

BEST MODE FOR CARRYING OUT THE INVENTION

In the sample introducing portion, a nozzle or a pulse valve provided with an orifice capable of producing supersonic molecular jet is used. Pulse valves are used for fuel injection in engines, etc., and as described in "Jikken Kagaku Koza", 4th Ed., vol. 8, pp 127–129, 1993, in general, a plunger enforced on a sealing surface by a spring is attracted backward electromagnetically by applying an electric current momentarily to a solenoid (electromagnetic coil) located behind the plunger, and the valve opens only for that time. Moreover, a Gentry-Giese type pulse valve and a pulse valve switching by using a piezo element have been developed, and these valves are also utilizable.

In the invention, since the time, while the laser beam for ionization interacts with the compound molecules to be measured, depends on the oscillation time of the pulsed laser beam, preferable pulse valves are those which work in an extremely short time up to a similar degree to the oscillation time (irradiation time) of the pulsed laser beam to be used. As an actual working time, the lower limit is 0.1 $\mu$s or more, preferably 1 $\mu$s or more, more preferably 10 $\mu$s or more, particularly preferably 10 $\mu$s or more, and the upper limit is 5 ms or less, preferably 2 ms or less, more preferably 500 $\mu$s or less, particularly preferably 200 $\mu$s or less.

Thereupon, when the working time of the commercial pulse valve is long, the working time of the valve can be made shorter by lengthening the spring and simultaneously raising the strength of the spring, or by decreasing the electric resistance of the coil so that a great electric current can be applied and simultaneously raising the working voltage. The size of the opening of the nozzle is designed so as to produce a supersonic molecular jet. Although the size depends on the exhaust capacity of a vacuum ionization chamber, etc., about 0.01 to 1 $mm^3$, particularly about 0.2 to 0.5 $mm^3$, as an opening area is, in general, suitable.

When two or more pinhole nozzles or a slit nozzle are used as the nozzle of the sample introducing portion, it is enough only to change the nozzle portion of a commercial mass spectrometer for them. Although the type of sample introduction may be either continuous introduction or pulse introduction, the pulse introduction type is preferable in view of the load on an exhaust system such as a pump. Preferable valves are the aforementioned ones.

Respective pinhole nozzles may be mounted either on the same valve or the like or on separate valves or the like. That is, the valve or the like of a sample introducing portion may be singular or plural. The size of the opening of each nozzle is designed so as to produce a supersonic molecular jet. Although the size depends on the exhaust capacity of a vacuum ionization chamber, etc., about 0.05 to 3 mm, particularly 0.1 to 1 mm as the diameter is, in general, suitable. The distance between the respective nozzles may be about 5 to 200 mm, usually about 20 to 50 mm. In the case that the number of nozzles is 3 or more, each nozzle may be arranged straight or at random. The direction of the nozzles is preferably set so as to meet molecular jets ejected from respective nozzles in the range of from the front side of a repeller electrode to an accelerating electrode, preferably around the repeller electrode. That is, an important matter is that ionized molecules do not diffuse into space. For that purpose, it is necessary that the are of the ionized molecules is as small as possible at the entrance of mass spectrometer, i.e. at the repeller electrode. As an actual means, it is preferable so as to meet the molecular jets ejected from 2 or more nozzles around the repeller electrode.

In the case of using 2 or more pinhole nozzles, a skimmer may be not used. However, using a skimmer is preferable because of decreasing the disturbance of the other molecular jets to a certain degree and of decreasing the load on the exhaust system of the mass spectrometer. The skimmer is located so as to partition the nozzle and the vacuum ionization chamber, so as to inhibit peripheral molecular jet streams from entering the vacuum ionization chamber, and so as to pass only the central portion of the molecular jet stream. Accordingly, the skimmer is, in principle, arranged so that the center of its opening is almost consistent with that of the opening of a nozzle. A suitable distance between the exhaust opening of the nozzle which forms the molecular jet and the skimmer slit is about 2 to 300 mm, particularly about 7 to 100 mm. A suitable opening diameter of the skimmer is about 0.1 to 1 mm, particularly about 0.2 to 0.8 mm. In order to inhibit the diffusion of the molecular jet which has passed the slit, it is preferable that the skimmer is projected toward the sample introducing side. The skimmer isolates the vacuum ionization chamber so as not to pass except the opening. As the material of the skimmer, metals such as SUS and aluminum, glass, heat-resistant plastic and the like are usable. An exhaust means is provided which inhibits the molecular jet portion cut by the skimmer from entering the vacuum ionization chamber.

The size of the slit of the slit nozzle is designed so as to produce a supersonic molecular jet. Although the size depends on the exhaust capacity, etc., in general, it is about 0.01 to 1.0 mm, particularly about 0.1 to 0.8 mm in width, about 5 to 200 mm, particularly about 10 to 30 mm in length, and a ratio of width:length of about 1:1 to 1:1000, particularly about 1:10 to 1:300. As the mounting method of the nozzle, there is an assembly composed of a slit nozzle and valves, i.e. a pressure provided with a slit and a cord which seals the slit, rendered to work by 3 commercial pulse valve driving mechanisms, as disclosed in the aforementioned Review Science Instrumentation, vol. 67, pp 410–417, 1996. If the length is not so long, i.e. about 30 mm or less, the number of driving mechanisms can be one.

In the case of using the slit nozzle, a slit skimmer is provided which partitions between the slit nozzle and the vacuum ionization chamber and inhibits the peripheral portions of the stream of molecules of the molecular jet from entering the vacuum ionization chamber. The slit of the skimmer is designed so as to pass only the central portion of the molecular jet ejected from the nozzle of the sample introducing portion. Accordingly, the skimmer is, in principle, arranged so that the center of the slit is almost consistent with that of the slit of the nozzle. A suitable distance between the exhaust opening of the slit nozzle which forms the molecular jet and the slit of the slit skimmer is about 3 to 30 mm, particularly about 7 to 25 mm. The width and length of the slit of the skimmer is preferably not shorter than the width and the length of that of the slit nozzle, and at the maximum, twice or less of that of the slit nozzle. A more preferable size is 1.2 to 1.5 times. A suitable size of the slit of the skimmer is about 0.01 to 1.2 mm, particularly about 0.1 to 1.0 mm in width, about 5 to 200 mm, particularly about 10 to 30 mm in length, and a ratio of width:length of about 1:4 to 1:1000, particularly about 1:10 to 1:150. Even when the slit of the skimmer is formed on a planar skimmer or the slit is projected on the side of the vacuum ionization chamber, the effects of the invention are still exhibited. Nevertheless, it is preferable that the slit is projected on the sample introducing side, in view of not diffusing or disturbing by convergence or collision the flow of the molecular jet which has passed the slit. Preferable projected forms are that both sides of the slit come close to each other from their bases toward the top of the slit in a form of straight of convex plane. A preferable angle between the center of the top of the slit and both bases of the slit is about 20 to 70 degrees, particularly about 40 to 50 degrees. The skimmer isolates the vacuum ionization chamber so as not to pass except the slit. As the material of the skimmer, metals such as SUS and aluminum, glass, heat-resistant plastic and the like are usable. An exhaust means is provided which inhibits the molecular jet portion cut by the slit skimmer from entering the vacuum ionization chamber.

The pulsed laser beam oscillator may be any one capable of oscillating a high output pulsed laser beam. For example, as the oscillator oscillating nanosecond order pulsed laser beams, the following ones can be used. That is, dye lasers are most commonly used. In the dye lasers, the wavelength can be continuously varied from 330 to 1000 nm by using excimer laser or yag laser as a pumping light source, and exchanging laser dyes. Recently, a light parametric oscillation laser was commercialized, and this laser can be used as the oscillator instead of dye laser. The generation region can be enlarged up to 220 nm by using multiple wave generation, mixing or the like of dye lasers. Femtosecond order laser beam can be oscillated by a system roughly composed of Xell excimer laser excited femtosecond pulsed dye laser and KrF excimer laser which is an amplifier. In this oscillator, a nanosecond dye laser is quenched, and further, a short cavity laser is excited. The excited laser passes a supersaturated absorber, and generates pulses of 9 pS. The pulsed beam is amplified by a dye amplifier, and is used as a pumping beam of a distribution feedback type dye laser. Finally, a femtosecond order pulsed laser beam having a wavelength in the ultraviolet region and an output of about 20 mJ at the maximum is obtained. In addition, by intercepting the oscillation of the femtosecond laser portion, a nanosecond order laser beam can be oscillated.

In the invention, it is preferable to use an ultrashort pulsed laser beam having a peak output of 1 MW or more oscillated by a pulsed laser beam oscillator. A preferable peak output is 10 MW to 100 GM, particularly preferably 100 MW to 10 GM. Hereupon, the peak output represents strength of laser beam, and is laser beam energy (J)/oscillation time (s).

As a method of raising the peak output, there is a method of shortening the laser beam oscillation time of 1 pulse and a method of raising the laser output. As to the irradiation time, since the ionization efficiency increases by rendering the peak output as great as possible wherein fragmentation of the molecules does not occur, the shorter irradiation time is better. On the other hand, in the theoretical viewpoint, laser multiphoton ionization is a process of transferring a molecule of a compound to be measured from the ground state to an excitation state by a photon having an energy corresponding to the energy difference between the ground state and the excitation state, and then ionizing by the energy of the photon. Thereupon, when a strong pulsed laser beam having a strength of not extremely decomposing the molecule is irradiated by reference to the excitation life which is the time it stays in the excitation state as a measure, the ion production increases remarkably by the improvement in ionization efficiency. A preferable irradiation time is 3 times that of the excitation life or less, more preferably twice or less, particularly preferably similar degree or less. On the other hand, the lower limit of the preferable irradiation time is $1/10000$ or more, more preferably $1/4000$ or more, particularly preferably $1/2000$ or more. In general, the preferable irradiation time is about 100 to 500 fs, more preferably 200 to 300 fs.

As to the laser beam energy, in the theoretical viewpoint, since the greater energy can make the peak output greater, the greater energy within the range of not decomposing the molecule is better. However, since there is occasionally a difference to a certain degree in density between the center of the laser beam and the outside thereof, and/or since distribution in the sense of fragmentation produced upon irradiation of the molecular jet occurs occasionally, even if the laser beam energy is decreased to a certain degree, the effects are still sometimes obtained. A preferable pulsed laser beam energy is 5 mJ or less, more preferably 4 mJ or less, particularly preferably 3 mJ or less. On the other hand, a preferable lower limit is 1 mJ or more, more preferably 2 mJ or more.

The wavelength of the laser beam to be irradiated preferably corresponds, in principle, to the energy difference between the intrinsic ground state and the intrinsic excitation state of each molecule to be measured, i.e. resonance wavelength. However, ionization still occurs by the non-resonance wavelength, and enough effects can be obtained.

The condensation means of the laser beam is not limited, and various forms can be used, such as a conventional one having a circle beam section, a planar one formed by using a special lens (cylindrical lens), etc.

The irradiation position of the laser beam is preferably prior to the molecular jet being influenced by another molecular jet. The reason is, when the molecular jet meets another molecular jet, the flow of molecules varies and/or molecular motion begins. Accordingly, the molecular jet becomes meaningless, and moreover, the S/N ratio lowers. On the other hand, when the molecules become ionized, even if the ionized molecules interact with the molecules derived from another molecular jet to some degree, the lowering of the S/N ratio is rare. By mounting a skimmer, only the molecules contributing to the signal of the uniform flow of molecules can be taken out, and interference between molecular jets is delayed because of the narrowing of the diameter of the molecular jet. As a result, the freedoms of the irradiation point and form of the laser beam are occasionally increased.

The ionization chamber has a structure capable of forming high vacuum conditions, and is provided with a window which is made of a material capable of passing a laser beam. The vacuum ionization chamber is occasionally connected with the vacuum chamber of a mass spectrometer without a partition. In such a case, the portion where ionization occurs corresponds to the vacuum ionization chamber.

The mass spectrometer may be any type of time-off-light type, quadropole type, double convergence type or so on.

The ionization chamber, the mass spectrometer adjacent thereto and further the molecular jet ejecting portion isolated by a slit skimmer are rendered to maintain vacuum conditions of about $10^{-6}$ to $10^{-8}$ torr by connecting an oil rotary pump, a mechanical booster pump, an oil diffusion pump, a turbo-molecular pump or the like.

It is preferable that the ionization chamber is evacuated by an oil-free turbo-molecular pump.

The turbo-molecular pump has a structure where rotor disc blades provided with oblique slit(s) and fixed disc blades of which the direction of the slit(s) is opposite are arranged alternately, and in general, the inlet port is located on the upper side, the outlet port is located on the underside, and the shaft of the rotor blades is set vertically. The rotor blades rotate at a high speed (2000 to 7000 rpm) in a similar degree to the translational movement of the molecules. The molecules collide with the rotor blade, and are forced down toward the downstream side, and conveyed to the outlet port. The compression ratio (the ratio of exhaust pressure to intake pressure) is a measure of pump performance. Since the compression ratio against large molecular weight hydrocarbons is high, an oil-free clean vacuum can be obtained. The vacuum degree in the vacuum chamber is made to be about $10^{-6}$ to $10^{-8}$ torr by the turbo-molecular pump, and a pump having the capacity corresponding thereto is selected.

Moreover, it is preferable to use a turbo-molecular pump as the exhaust means of the vacuum chamber of the mass spectrometer.

As to the sample introduction, in general, since the ionization chamber (or corresponding portion thereto) or the front chamber, when using a skimmer, is maintained at a pressure of $10^{-6}$ torr or less, around ordinary pressure is enough for the sample so long as it becomes a gas, and the sample can be introduced by the pressure as a driving force. Accordingly, the sample may not be pressurized, but high pressure samples can also be introduced directly without problems. On the other hand, to reduce the pressure is in some cases preferable, because of increasing the density of the molecular jet, which is well-known, and improving sensitivity, although the degree is minor.

The determination of the mass number and detection of the molecular ions can be conducted through the operation of a mass spectrometer under usual working conditions, and recorded by a usual digital oscilloscope, recorder.

EXAMPLE 1

A laser ionization mass spectrometric apparatus shown in FIG. 1 was prepared. Most of the parts used for the apparatus were commercial goods. That is, a pulse valve made by General Valve Company (PN91-47-900 (85 kg/cm$^2$)) was used for the sample introducing portion 1, a LPD 500 fs type laser system using a dye laser made by Lambda Physik Company was used for the pulsed laser beam oscillator 2, a time-of-flight type mass spectrometer having a flight tube 450 mm in length was used for the mass spectrometer 4, a F 1094 type microchannel plate made by Hamamatsu Photonics Co., Ltd. was used for the detector 46, and a 9360 type digital oscilloscope made by Lecroy Company was used for the recorder (not illustrated). The opening of the nozzle 12 of the pulse valve 11 was a circular hole 0.8 mm in inside diameter.

The vacuum chamber 40 of the mass spectrometer was evacuated by a UTM 150 type turbo-molecular pump made by Nippon Shinku Gijutsu Kabushiki Kaisha having an exhaust velocity of 190 l/s. The ionization chamber 3 by laser beam irradiation was evacuated by a ULK-06A type oil diffusion pump made by Nippon Shinku Gijutsu Kabushiki Kaisha having an exhaust velocity of 1200 l/s.

The pulsed laser beam 22 generated from the oscillator 2 was condensed by the lens 21, and entered the vacuum ionization chamber 3 through the window 31. On the other hand, the sample gas was introduced intermittently by the pulse valve 11 of the sample introducing portion 1, and ejected from the nozzle 12 to form the molecular jet 13. The molecular jet 13 entered the vacuum ionization chamber 3. The molecular jet 13 was radiated with the laser beam 22 and ionized there, and entered the mass spectrometer 4. In the mass spectrometer 4, the direction of the molecular jet was turned by 90 degrees by the repeller electrode 42, and then, accelerated by the high voltage accelerating electrode 43. Furthermore, the molecular jet passed the ion passing hole 44 provided on the partition wall 41, and each ion was detected by the ion detector 46. The detection signal was measured by the digital oscilloscope.

Using chlorobenzene as the sample gas, mass spectrometry was carried out.

With varying pulse widths and oscillation wavelengths of the laser beam, a laser beam of 4 ns to 1 ps, 1 to 1000 MW was oscillated. The wavelength was 48 nm.

Chlorobenzene was streamed together with argon gas at a constant concentration, and introduced into the vacuum ionization chamber in a molecular jet state through the pulse valve. The laser beam irradiated at varying energies of 1 mJ and 4 mJ, peak outputs of 1 MW, 10 MW, 100 MW and 1000 MW, to induce ionization. At that time, the irradiation time of the laser beam was in the range of 1 ps to 4 ns. The pulsed laser beam was irradiated while synchronized with the sample introduction. The produced ions were detected by the microchannel plate of the time-of-flight type mass spectrometer, and integrated 200 times by the digital oscilloscope to obtain spectra. The results are shown in FIG. 2.

COMPARATIVE EXAMPLE 1

Using the same apparatus as Example 1, the same experiment as Example 1 was carried out except that the oscillation of the femtosecond laser portion was intercepted and pulsed laser beams having an energy of 1 mJ or 4 mJ and a peak output of 100 KW or 400 KW were irradiated (irradiation time: 10 ns). The results are shown in FIG. 2.

Figure 2:
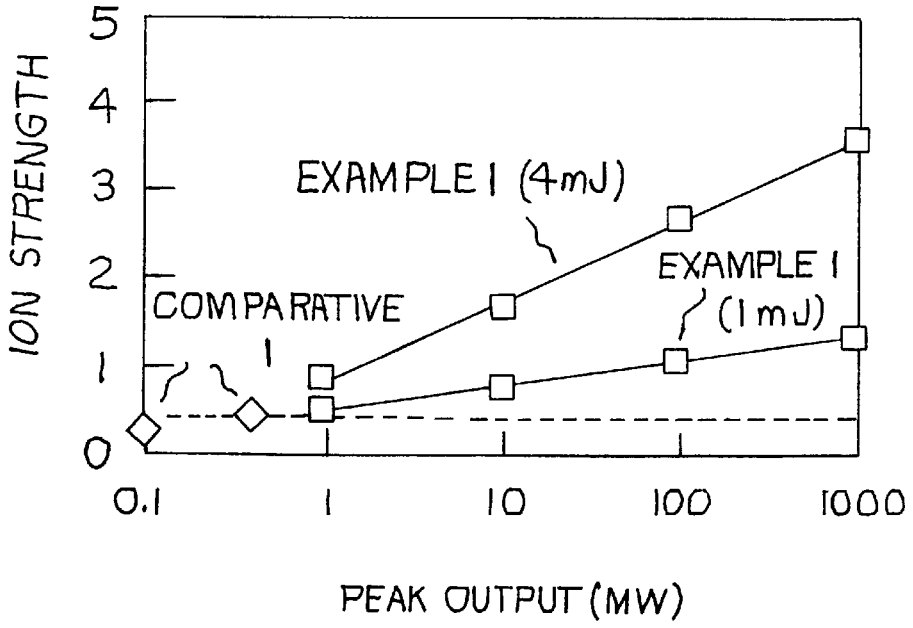
FIG. 2 is a graph showing the variation of molecular ion peak strength of chlorobenzene obtained in Example 1.

In the measurement shown in FIG. 2, fragment ions were not observed, and only molecular ions were observed. In the case of the pulsed laser beam having an energy of 1 mJ and a peak output of 400 KW, the ion strength was about 0.4, and in the case of the pulsed laser beam having an energy of 1 mJ and a peak output of 1 MW, the ion strength was about 0.5. Accordingly, the ion strength was increased by 20% or more, and it is apparent that the ion strength does not depend on the laser beam energy but on the peak output of the laser beam. Besides, it can be seen that in the case of the same pulsed laser beam energy, the greater peak output than the comparative example brings the greater ion strength, and the ion strength increases together with the peak output.

EXAMPLE 2

The same apparatus as Example 1 was used. A femtosecond order pulsed dye laser beam was oscillated by the LPD 500 fs type laser system made by Lambda Physik Company. The wavelength was 248 nm, which was the same as Example 1.

Figure 3:
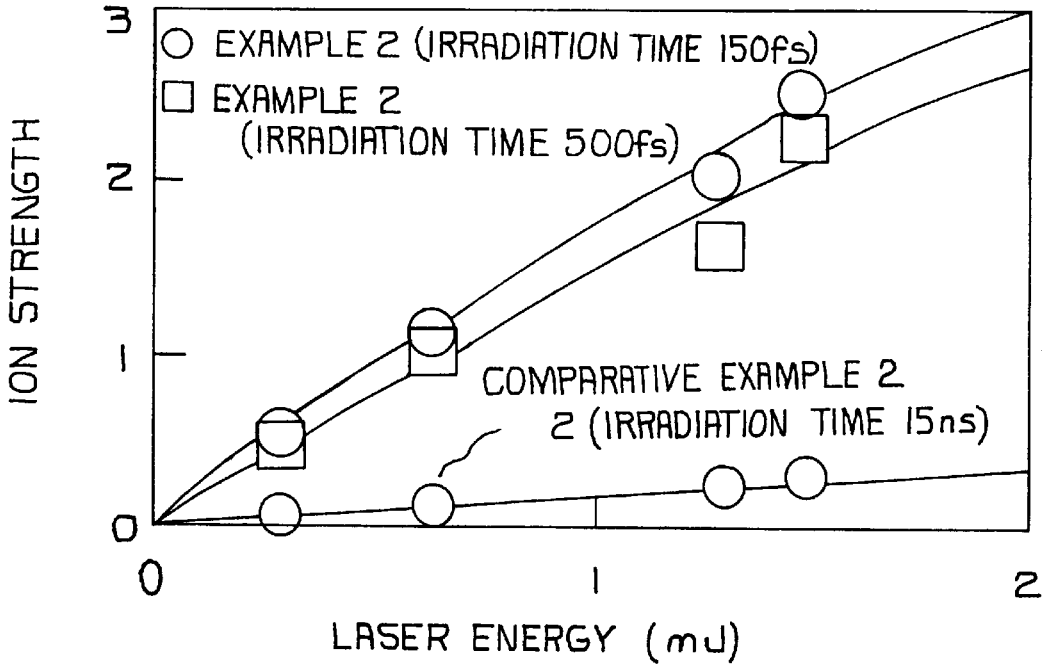
FIG. 3 is a graph showing the variation of molecular ion peak strength of chlorobenzene obtained in Example 2.
Figure 4:
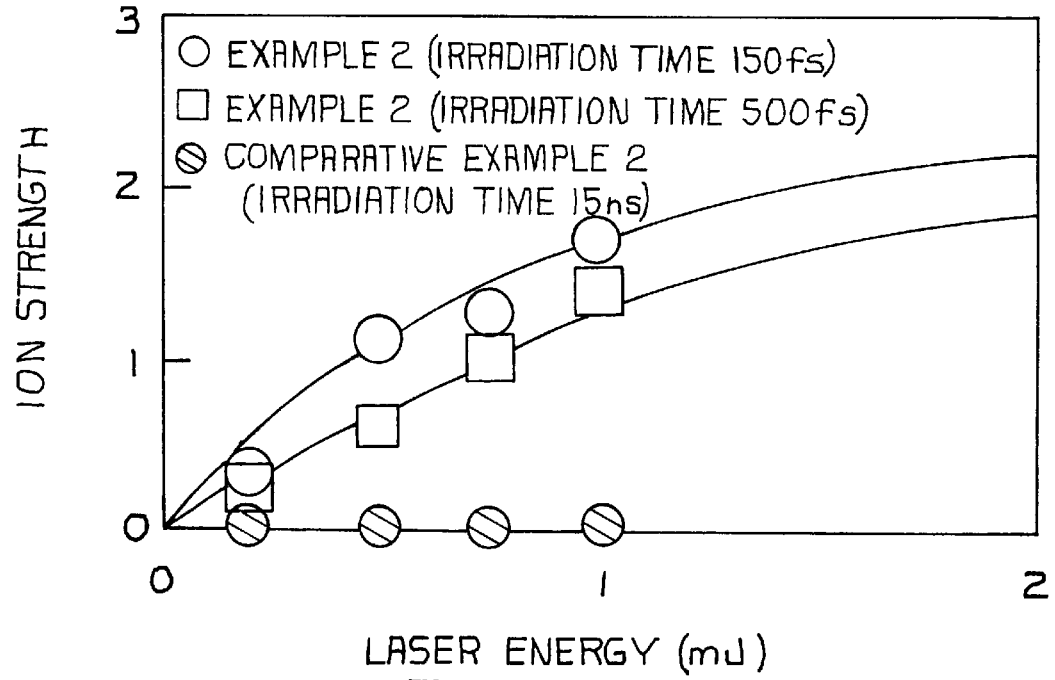
FIG. 4 is a graph showing the variation of molecular ion peak strength of bromobenzene obtained in Example 2.
Figure 5:
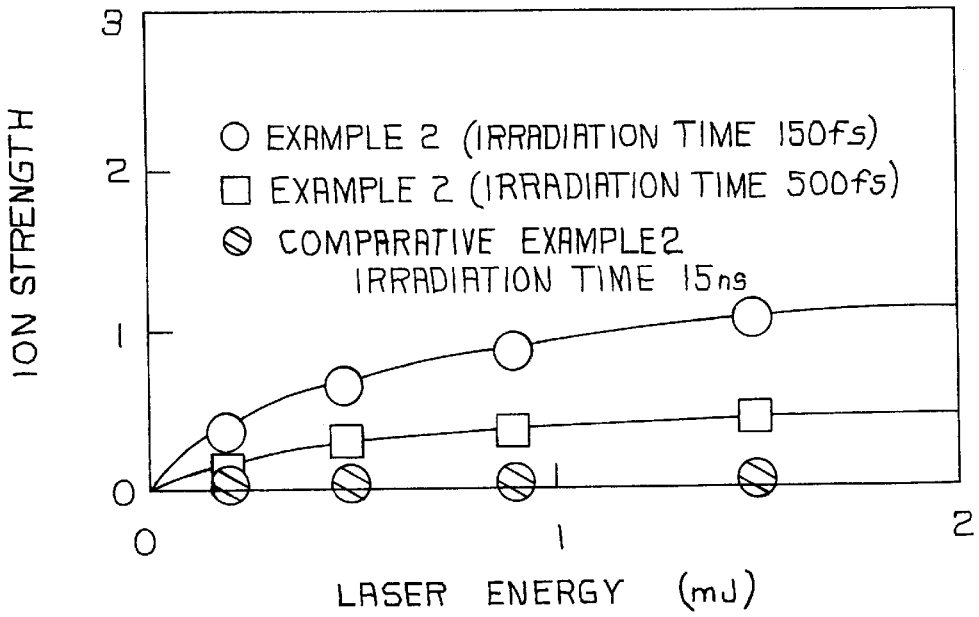
FIG. 5 is a graph showing the variation of molecular ion peak strength of iodobenzene obtained in Example 2.

Chlorobenzene, bromobenzene or iodobenzene was introduced into the high vacuum ionization chamber together with argon gas as supersonic molecular jet at a constant concentration. Taking the excitation life of each molecule into consideration, the laser beam irradiated for 500 fs and 150 fs, with varying peak output and irradiation energy in the range of 0.2 to 1.5 mJ, to induce ionization. At that time, the peak output was 0.4 to 10 GW. The produced ions were detected by the microchannel plate of the time-of-flight type mass spectrometer, and integrated 200 times by the 9360 type digital oscilloscope made by Lecroy Company to obtain the spectra. The results are shown in FIG. 3, FIG. 4 and FIG. 5.

COMPARATIVE EXAMPLE 2

Using the same apparatus as Example 1, the same experiments as Example 2 were carried out except that the oscillation of the femtosecond laser portion was intercepted and a pulsed laser beam of 15 ns was used to irradiate. The results are shown in FIG. 3 to 5.

Hereupon, the excitation life of chlorobenzene is 600 ps, and 500 fs, 150 fs and 15 ns of laser beam irradiation time correspond to $1/1200$, $1/4000$, 25 times, respectively. The excitation life of bromobenzene is 30 ps, and accordingly, correspond to $1/60$, $1/200$, 500 times, respectively. Similarly, the excitation life of iodobenzene is reported to be about 400 fs, and accordingly, correspond to about $1/1.3$, about $1/2.7$, about 37500 times, respectively. As can be seen from FIG. 5, the effects can be recognized at an irradiation time almost similar to the excitation life, and as can be seen from FIGS. 3 and 4, the effects are exhibited up to the irradiation time of $1/10000$ of the excitation life. Moreover, it can be seen that effects of remarkable ionization efficiency improvement are obtained by irradiating the laser beam by reference to the excitation life as a measure.

Furthermore, since Example 1 and Example 2 were carried out using the same apparatus under the same conditions except that the peak output, irradiation time and energy of the laser beam were varied, the ion strength values can be compared, although they are relative values. Accordingly, it can be seen from FIG. 2 and FIG. 3 that the ionization efficiency improves with the increased peak output by the energy so far as fragmentation of molecules does not occur. That is, the laser beam energy of 1 mJ and the irradiation time of 500 fs, 150 fs in FIG. 3 correspond to peak output of 2 GW (2000 MW), 6, 7 GW (6700 MW). At that time, the ion strength is 1.5 and 1.7, respectively. Upon looking at FIG. 2, the ion strength at 1 mJ laser beam energy increases with an increasing peak output, and is 1.4 at 1000 MW. It is apparent that ionization efficiency is improved by the increase of peak output.

As can be seen from the comparison of Examples 1 and 2 with Comparative Examples 1 and 2, according to the invention, ionization efficiency is improved by the irradiation of an ultrashort pulsed laser beam having a great peak output, but extreme fragmentation does not occur because the irradiation energy does not become great due to the short irradiation time. Accordingly, a high sensitivity detection is possible, and the lower limit of determination (detection) can be lowered.

EXAMPLE 3

Figure 6:
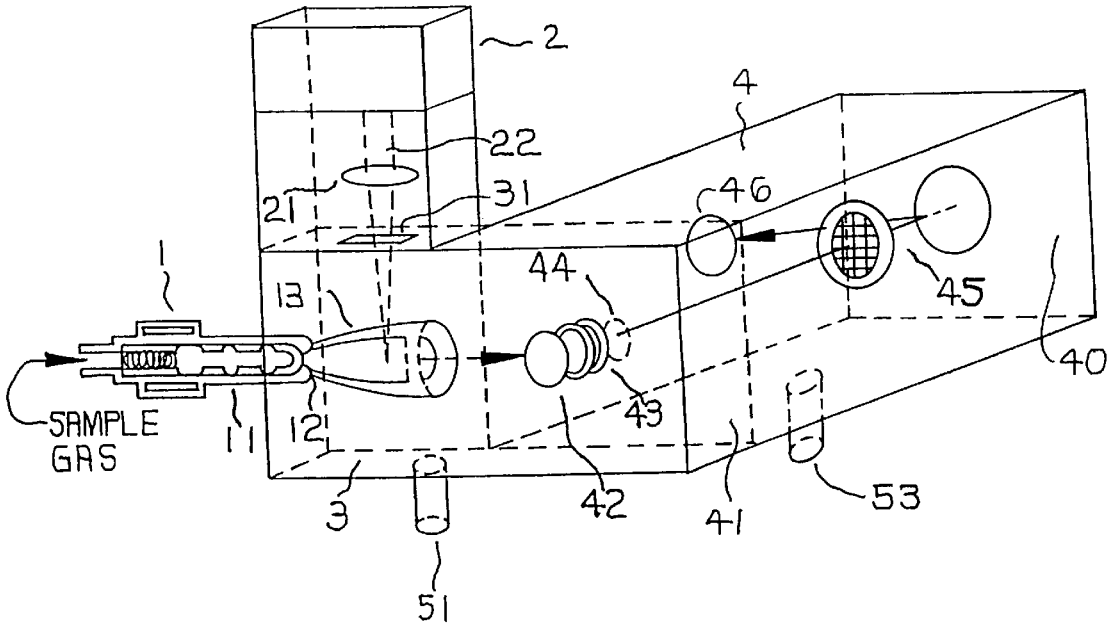
FIG. 6 is a drawing illustrating the construction of an apparatus which is another example of the invention.

A laser ionization mass spectrometric apparatus shown in FIG. 6 was prepared. Most of the parts used for the apparatus were commercial goods. That is, a pulse valve made by General Valve Company (PN91-47-900 (85 kg/cm$^2$)) was used for the sample introducing portion 1, a MOPO-730 type laser system made by General Valve Company was used for the pulsed laser beam oscillator 2, a reflectron time-of-flight type mass spectrometer having a flight tube 1200 mm in length was used for the mass spectrometer 4, a F 1094 type microchannel plate made by Hamamatsu Photonics Co., Ltd. was used for the detector 46, and a 9360 type digital oscilloscope made by Lecroy Company was used for the recorder (not illustrated). The opening of the nozzle 12 of the pulse valve 11 was a circular hole 0.8 mm in inside diameter.

The vacuum chamber 40 and the ionization chamber 3 by laser beam irradiation of the mass spectrometer were evacuated by an UTM 150 type turbo-molecular pump, made by Nippon Shinku Gijutsu Kabushiki Kaisha, having an exhaust velocity of 190 l/s.

The pulsed laser beam 22 generated from the oscillator 2 was condensed by the lens 21, and entered the vacuum ionization chamber 3 through the window 31. On the other hand, the sample gas was introduced intermittently by the pulse valve 11 of the same introducing portion 1, and ejected from the nozzle 12 to form molecular jet 13. The molecular jet 13 entered the vacuum ionization chamber 3. The molecular jet 13 was irradiated with the laser beam 22 and ionized there, and entered the mass spectrometer 4. In the mass spectrometer 4, the direction of the molecular jet was turned 90 degrees by the repeller electrode 42, and then, accelerated by the high voltage accelerating electrode 43. Thereafter, the molecular jet passed the ion passing hole 44. Furthermore, the molecular jet was reflected by the ion reflector 45, and each ion was detected by the ion detector 46. The detection signal was measured by the digital oscilloscope.

Using o-chlorophenol as the sample gas, mass spectrometry was carried out.

A nanosecond order pulsed laser beam having a wavelength of 278.5 nm and a pulse width of 5 ns was used. The energy of the pulsed laser beam was 1 mJ.

Figure 7:
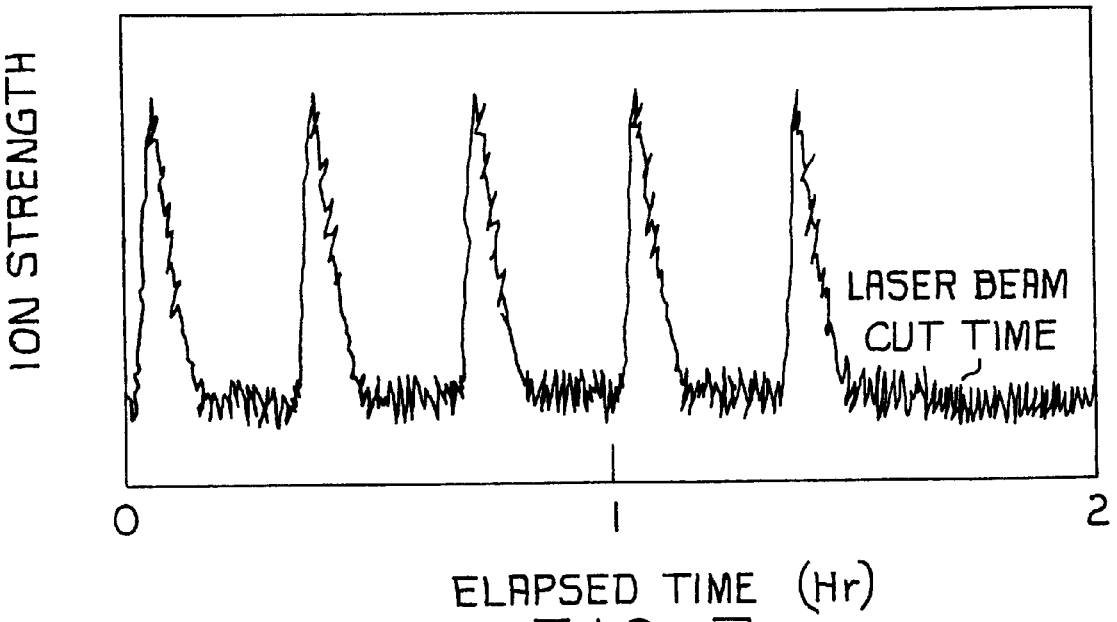
FIG. 7 is a graph showing the variation with time of the ion strength of o-chlorophenol and the signal of the detection system upon cutting the laser beam (short period sample introduction · turbo-molecular pump exhaust) measured by using the apparatus of FIG. 6.

A definite amount of o-chlorophenol was dropped to a 500 ml flask where argon gas was streamed (initial concentration: about 200 ppm). The dropping rate was 1 time/20 minutes. The above pulse valve, which was connected to the outlet of the flask in a form of dispensing a part of the discharge gas, was opened for 200 $\mu$s at a rate of 10 times/second, and o-chlorophenol was introduced into the high vacuum ionization chamber as a supersonic molecular jet. Synchronizing therewith, a pulsed laser beam was used to irradiate, and the produced ions were detected by the microchannel plate of the time-of-flight type mass spectrometer. Spectra were obtained by the digital oscilloscope, and the variation with time was recorded. Further, about 20 minutes from the termination of o-chlorophenol dropping, the laser beam was cut. The results are shown in FIG. 7.

COMPARATIVE EXAMPLE 3

Using the same apparatus as Example 3, the same experiment as the example was carried out except that the ionization chamber was evacuated by a ULK-06A type oil diffusion pump made by Nippon Shinku Gijutsu Kabushiki Kaisha having an exhaust velocity of 1200 l/s. The results are shown in FIG. 8.

COMPARATIVE EXAMPLE 4

The experiment was carried out using the same apparatus as the example except that a fuel injection valve for an automobile engine was reconstructed and used as the pulse valve (opening time: 1.5 ms). The results are shown in FIG. 8.

Figure 8:
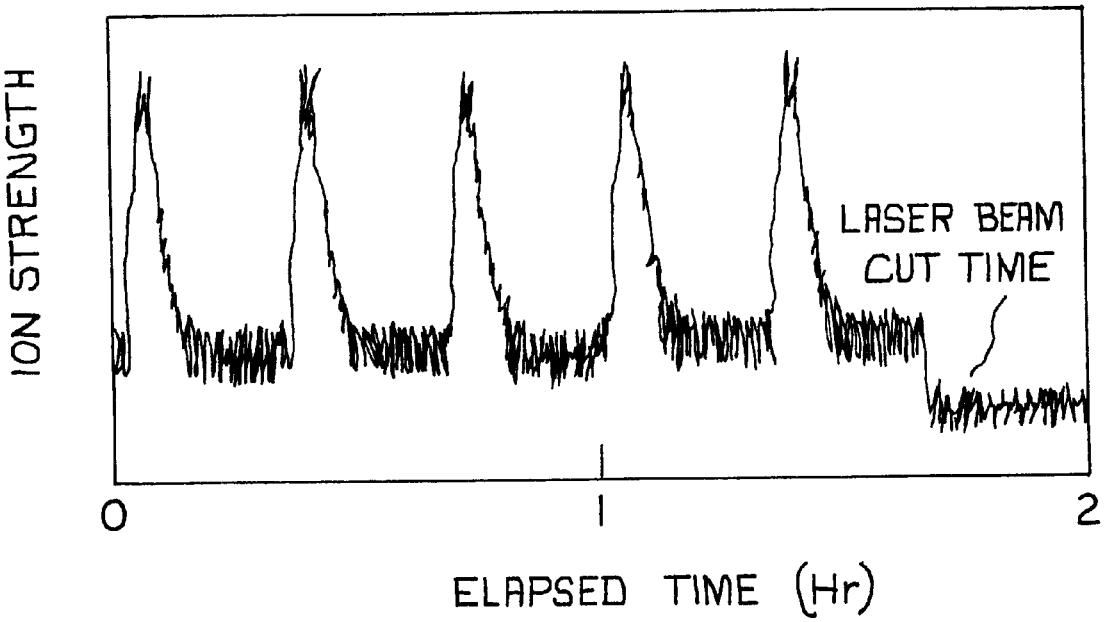
FIG. 8 is a graph showing the variation with time of the ion strength of o-chlorophenol and the signal of the detection system upon cutting the laser beam (short period sample introduction · oil diffusion pump exhaust).
Figure 9:
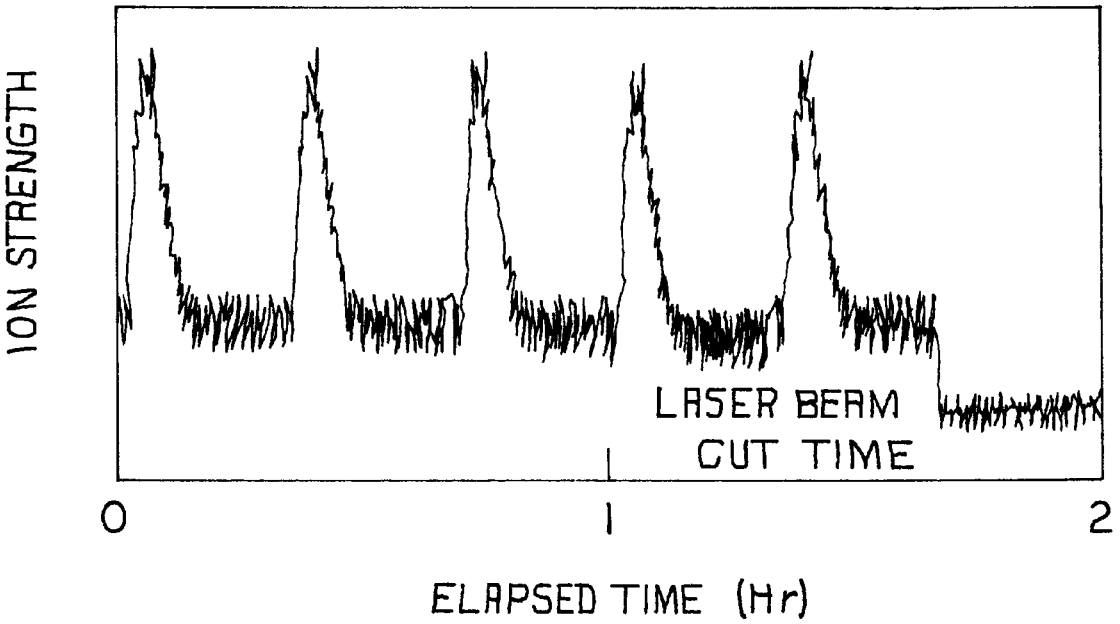
FIG. 9 is a graph showing the variation with time of the ion strength of o-chlorophenol and the signal of the detection system upon cutting the laser beam (conventional sample introduction · turbo-molecular pump exhaust).

In FIGS. 7–9, the ion strength upon cutting the laser beam corresponds to the zero point level because of not producing ions, and vibration (variation) is noise of the detection system. It is apparent that, in Example 3 in a comparison with Comparative Example 3, the background noise lowered, and due to the introduction of the sample not in quantity, the variation was small, and the noise decreased. That is, it can be seen that high sensity detection is possible. The effects must appear, in principle, by using a turbomolecular pump and shortening the opening time compared to a conventional period, but remarkable effects appear in the case of an opening time of 500 $\mu$s or less.

As can be seen from the comparison of Example 3 with Comparative Examples 3 and 4, according to the invention, since the background noise caused by oil or a residual sample can be reduced due to the shortening of the sample introduction time and using an oil-free pump for the exhaust of the ionization chamber, high sensitivity detection is possible and the determination (detection) lower limit can be lowered.

EXAMPLE 4

Figure 10:
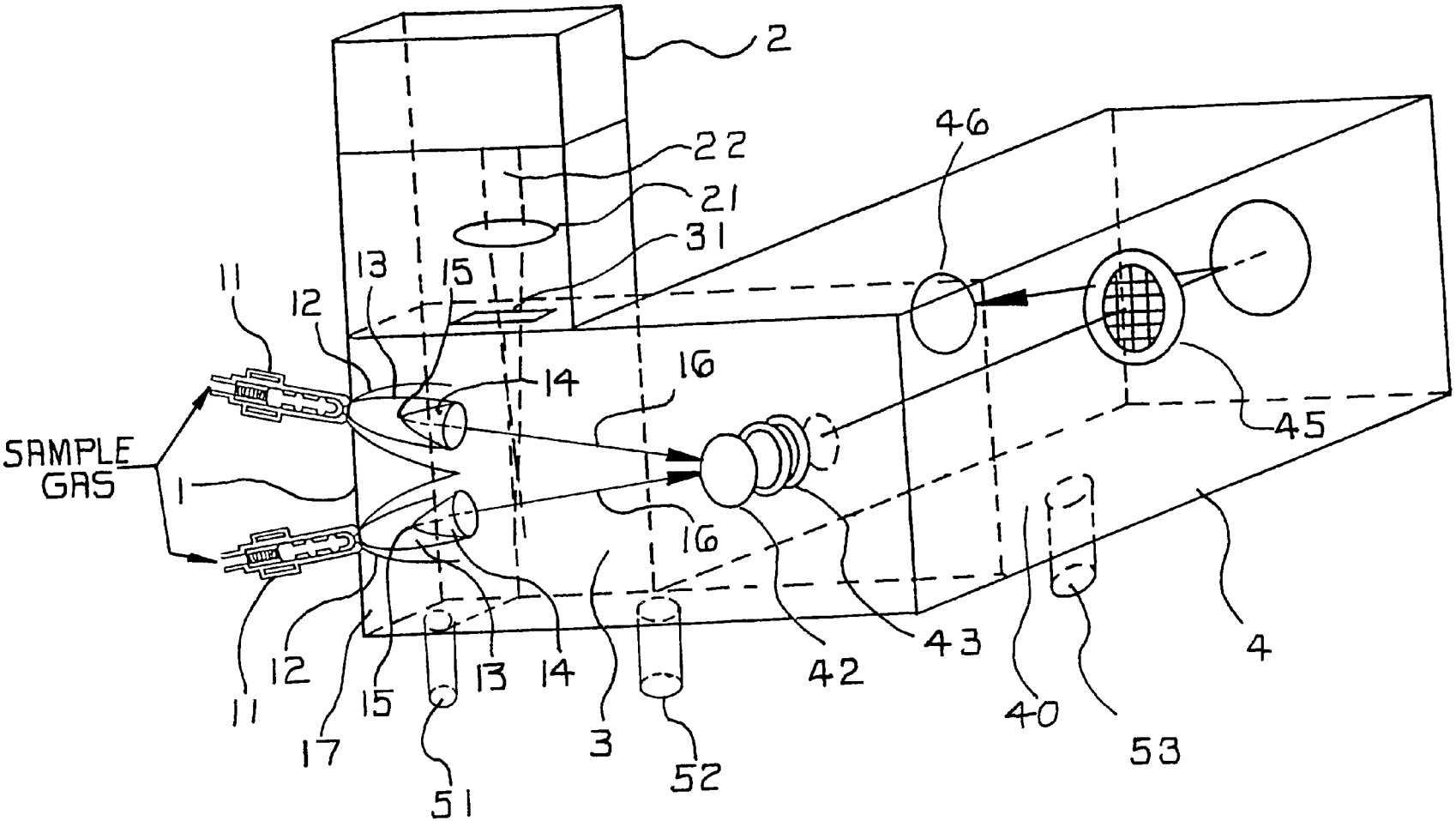
FIG. 10 is a drawing illustrating the construction of an apparatus which is another example of the invention.
Figure 11:
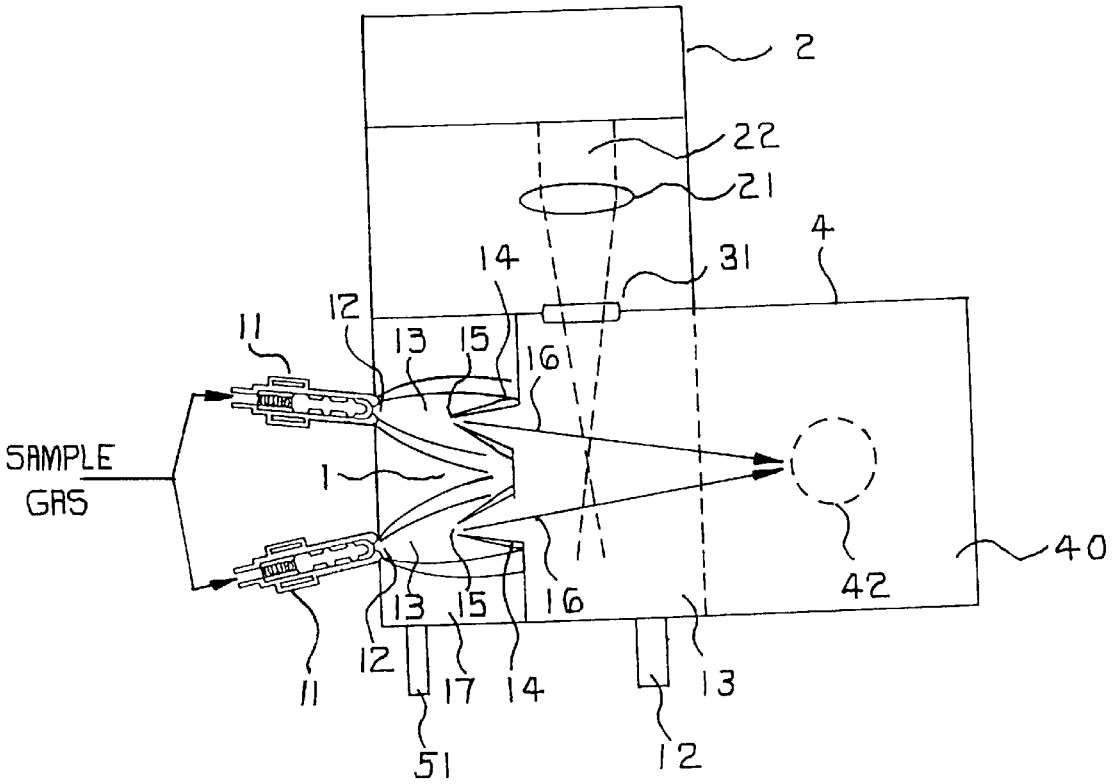
FIG. 11 is a section of a sample introducing portion, a pulsed laser beam oscillator and a vacuum ionization chamber portion of the apparatus.

A laser ionization mass spectrometric apparatus shown in FIGS. 10–11 was prepared. Most of the parts used for the apparatus were commercial goods. That is, a pulse valve made by General Valve Company (PN91-47-900 (85 kg/cm$^2$)) was used for the sample introducing portion 1, a MOPO-730 type laser system made by General Valve Company was used for the pulsed laser beam oscillator 2, a reflectron time-of-flight type mass spectrometer having a flight tube 1200 mm in length was used for the mass spectrometer 4, a F 1094 type microchannel plate made by Hamamatsu Photonics Co., Ltd. was used for the detector 46, and a 9360 type digital oscilloscope made by Lecroy Company was used for the recorder (not illustrated).

The pulse valve 11 shown in FIG. 11 was mounted on the sample introducing portion. The pulse valve was made of stainless steel, and two pinhole nozzles 12 having an opening diameter of 0.2 mm were provided apart from each other at a distance between their centers of 30 mm.

The skimmer 14 was made of stainless steel having a thickness of 0.8 mm, a hole diameter of 0.3 mm, an outer wall angle of 55 degrees and inner wall angle of 45 degrees at the top. The position of the skimmer was 25 mm apart from the nozzle. Two same form nozzles and skimmers were located so that their molecular jets met at an angle of 20 degrees as to meet at the position of the repeller electrode of the mass spectrometer, and the two nozzles were worked together while synchronized with the laser beam.

The pulsed laser beam 22 generated from the oscillator 2 was condensed by the lens 21, and entered the vacuum ionization chamber 3 through the window 31. On the other hand, the sample gas was introduced intermittently by the pulse valve 11 of the sample introducing portion 1, and ejected from the nozzle 12 to form molecular jet 13. The molecular jet 13 collided with the skimmer 14 and only the central portion thereof passed the hole 15 of the skimmer 14, and entered the vacuum ionization chamber 3. The molecular jet 16 was irradiated with the laser beam 22 and ionized there, and entered the mass spectrometer 4. The irradiation direction of the laser beam 22 was in the same plane as the plane made by the two molecular jets, and was at a right angle to the symmetry axis of the two molecular jets. In the vacuum chamber 40 of the mass spectrometer 4, the direction of the molecular jet 16 was turned 90 degrees by the repeller electrode 42, and then, accelerated by the high voltage accelerating electrode 43. Furthermore, the molecular jet was reflected by the ion reflector 45 and each ion was detected by the ion detector 46. The detection signal was measured by the digital oscilloscope. The front chamber 17 isolated by the skimmer 14, the vacuum ionization chamber 3 and the vacuum chamber 40 of the mass spectrometer were connected to an exhaust system, respectively, and their insides were kept in vacuum conditions.

Using chlorobenzene as the sample gas, mass spectrometry was carried out. At that time, the laser beam energy was 2 mJ, irradiation time was 5 ns, and the wavelength was 269.8 nm. Chlorobenzene was introduced into the high vacuum ionization chamber 4 together with argon gas at a definite concentration as a supersonic jet. The produced ions were detected by the microchannel plate, and integrated 10 times by the digital oscilloscope to obtain spectra. The results are shown in FIG. 12.

COMPARATIVE EXAMPLE 5

Using the same apparatus as Example 4 except that one nozzle was not used, and the same experiment was carried out. The results are shown in FIG. 12.

Figure 12:
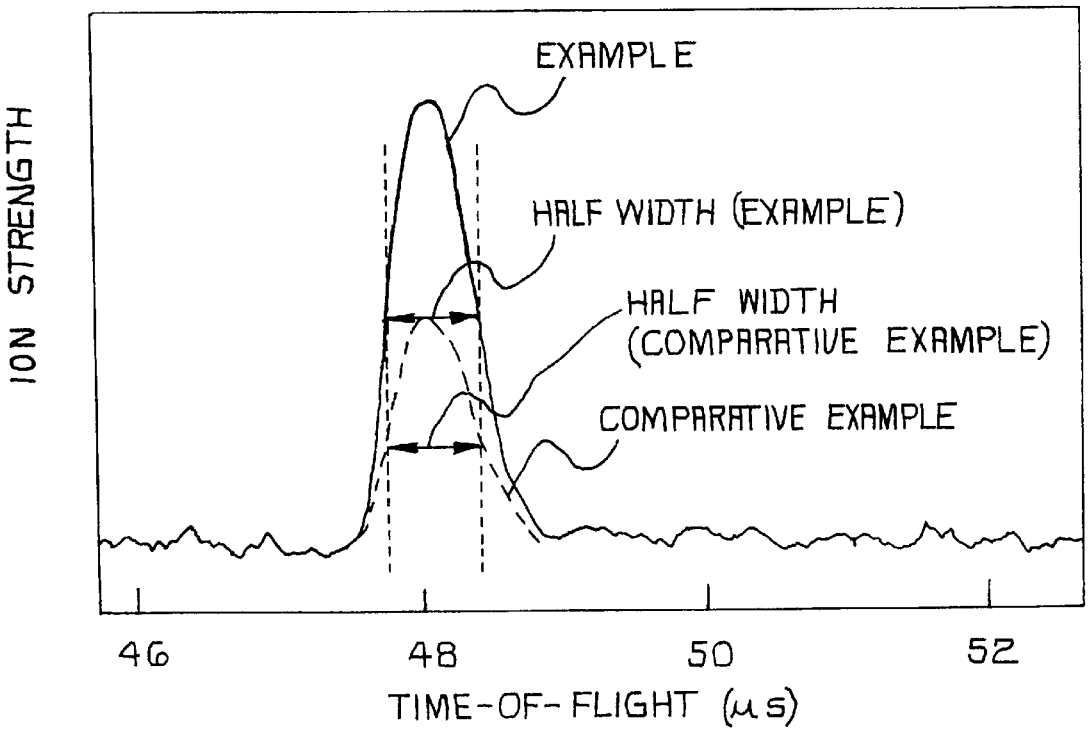
FIG. 12 is a graph showing the mass spectra of chlorobenzene obtained by using the apparatus of FIG. 10.

As can be seen from FIG. 12, it was found that the peak width did not vary between Example 4 and Comparative Example 5. Since twice the amount of sample was introduced by using two nozzles in Example 4 as compared with Comparative Example 5, it is apparent that the S/N ratio doubled. Accordingly, since a large amount of sample can be introduced without broadening the peak width, it is possible to measure in high sensitivity directly in proportion to the introduced amount of sample. That is, it means that a high sensitivity measurement is possible with the analyzer, especially exhaust system, rendered compact as it is, because the introducing portion is considerably smaller compared with other portions.

As can be seen from the comparison of Example 4 with Comparative Example 5, according to the invention, since a large amount of sample can be introduced without raising the capacity of the mass spectrometer, i.e. using an inexpensive compact mass spectrometer, sensitivity can be improved while a laser ionization mass spectrometric apparatus is kept compact.

EXAMPLE 5

Figure 13:
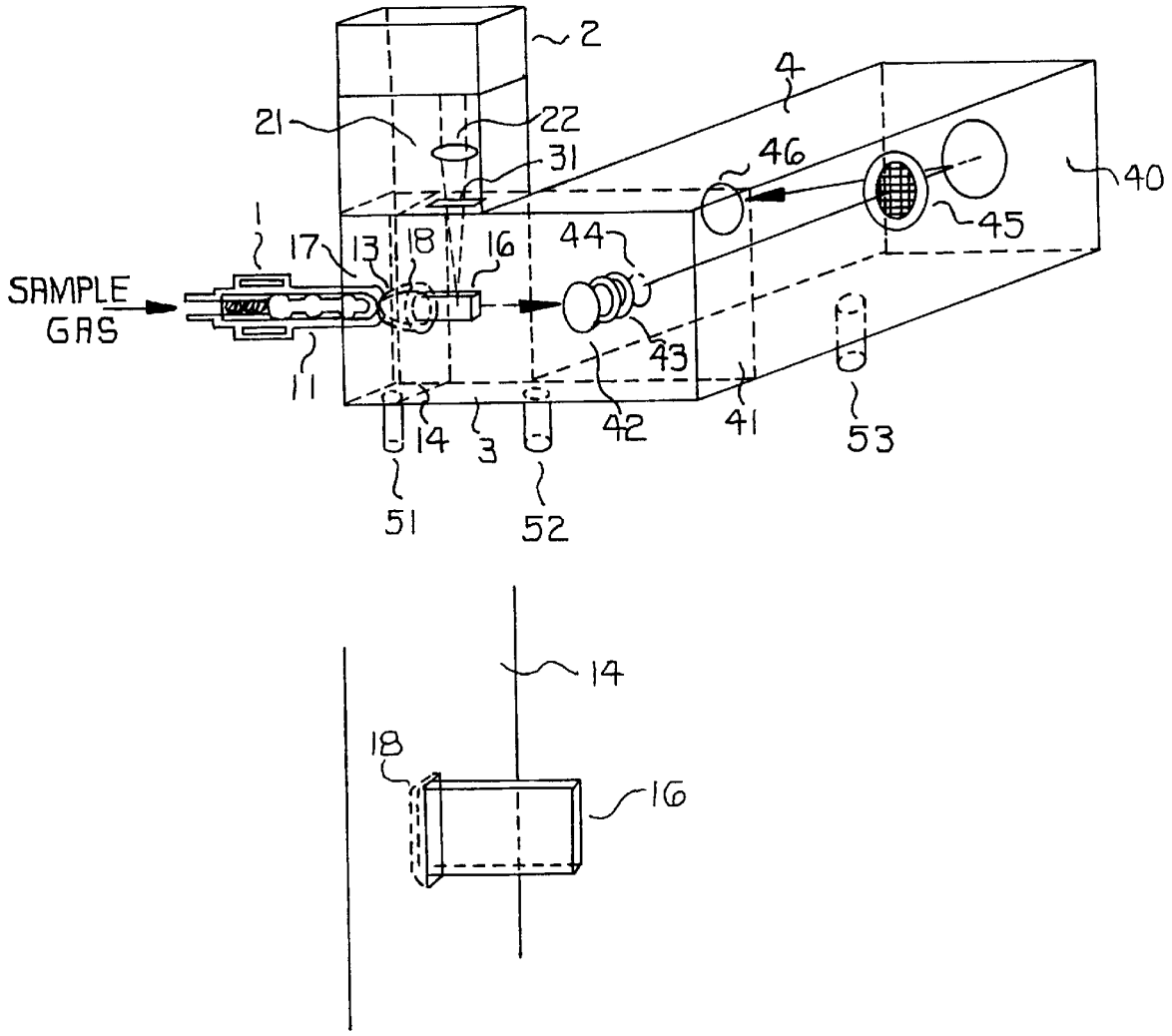
FIG. 13 is a drawing illustrating the construction of an apparatus which is another example of the invention.
Figure 14:
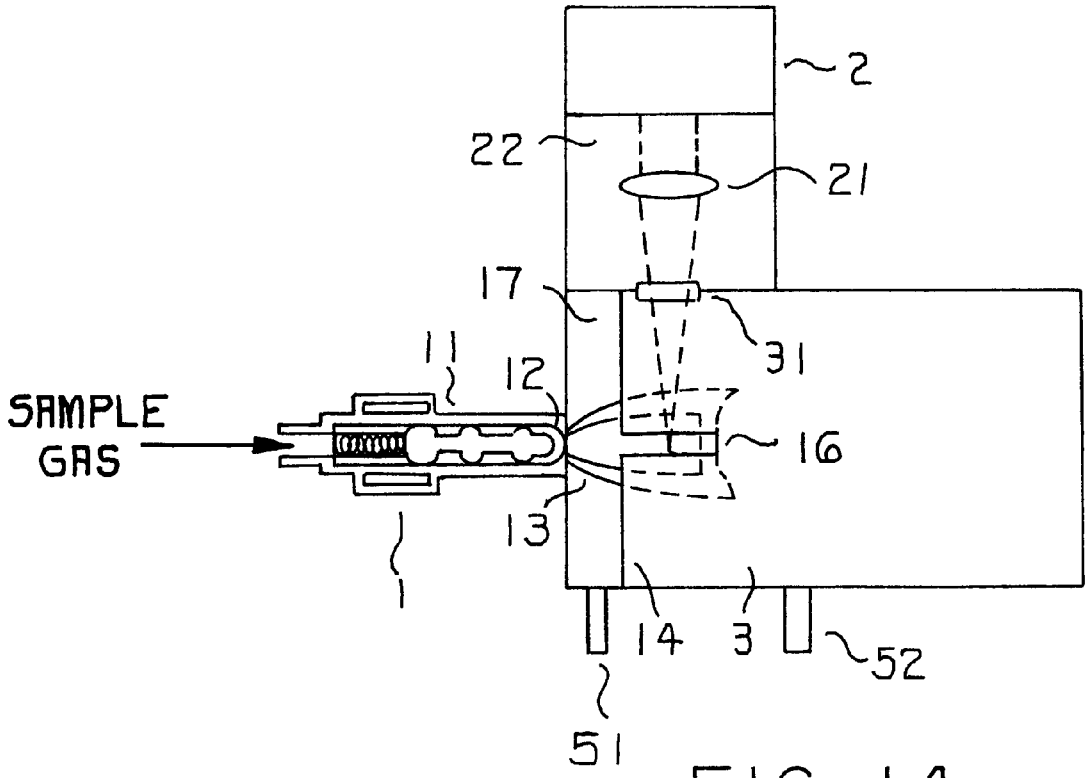
FIG. 14 is a section of a sample introducing portion, a slit skimmer, a pulsed laser beam oscillator and a vacuum ionization chamber portion of the apparatus.

A laser ionization mass spectrometric apparatus shown in FIGS. 13–14 was prepared. Most of the parts used for the apparatus were commercial goods. That is, a pulse valve made by General Valve Company (PN91-47-900 (85 kg/cm$^2$)) was used for the sample introducing portion 1, a MOPO-730 type laser system made by General Valve Company was used for the pulsed laser beam oscillator 2, a reflectron time-of-flight type mass spectrometer having a flight tube 1200 mm in length was used for the mass spectrometer 4, a F 1094 type microchannel plate made by Hamamatsu Photonics Co., Ltd. was used for the detector 46, and a 9360 type digital oscilloscope made by Lecroy Company was used for the recorder (not illustrated).

The slit nozzle 12 of the sample introducing portion was made of SUS, and the size of the slit opening was 0.1 mm×10 mm.

Figure 15A:
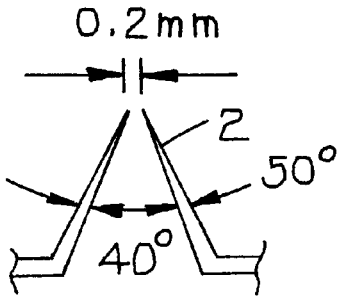
FIG. 15 is a section of a slit portion of two types of slit skimmers used in the above apparatus.
Figure 15B:
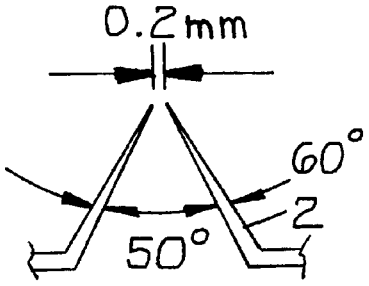

Two types of slit skimmers 14 having a section shown in FIG. 15 were prepared. One of the angles between the center of the top of the slit and both bases of the slit was 40 degrees, and the other one was 50 degrees. The skimmers were made of aluminum having a maximum thickness of 1.2 mm. The top of the slit was sharpened, and the size of the opening of the slit 18 was 0.2 mm×12 mm. The position of the slit skimmer 14 was 25 mm apart from the nozzle 12, and the nozzle 12 and the skimmer 14 were located so that the direction of the major axis and the center of them confirmed to each other.

The pulsed laser beam 22 generated from the oscillator 2 was condensed by the lens 21, and entered the vacuum ionization chamber 3 through the window 31. On the other hand, the sample gas was introduced intermittently by the pulse valve 11 of the sample introducing portion 1, and ejected from the slit nozzle 12 to form molecular jet 13. The molecular jet 13 collided with the skimmer 14, and only the central portion thereof passed the slit 18 of the skimmer 14, and almost only parallel streams entered the vacuum ionization chamber 3. The molecular jet 13 was irradiated with the laser beam 22 and ionized there, and entered the mass spectrometer 4. In the mass spectrometer 4, the direction of the molecular jet 16 was turned 90 degrees by the repeller electrode 42, and then, accelerated by the high voltage accelerating electrode 43. Thereafter, the molecular jet passed the ion passing hole 44, and reflected by the ion reflector 45, and then, each ion was detected by the ion detector 46. The detection signal was measured by the digital oscilloscope. The front chamber 17 isolated by the slit skimmer 14, the vacuum ionization chamber 3 and the vacuum chamber 40 of the mass spectrometer were connected to an exhaust system, respectively, and their insides were kept in vacuum conditions.

Using chlorobenzene as the sample gas, mass spectrometry was carried out. At that time, the laser beam energy was 2 mJ, irradiation time was 5 ns, and the wavelength was 269.8 nm. Chlorobenzene was introduced into the high vacuum ionization chamber 3 together with argon gas at a definite concentration as a supersonic jet. The produced ions were detected by the microchannel plate, and integrated 10 times by the digital oscilloscope to obtain spectra. The results are shown in FIG. 16.

COMPARATIVE EXAMPLE 6

Using the same apparatus as Example 5 except that the slit skimmer was not added, the same experiment was carried out. At that time, a molecular jet was ejected as shown by a dotted line in FIG. 14. The results are shown in FIG. 16.

Figure 16:
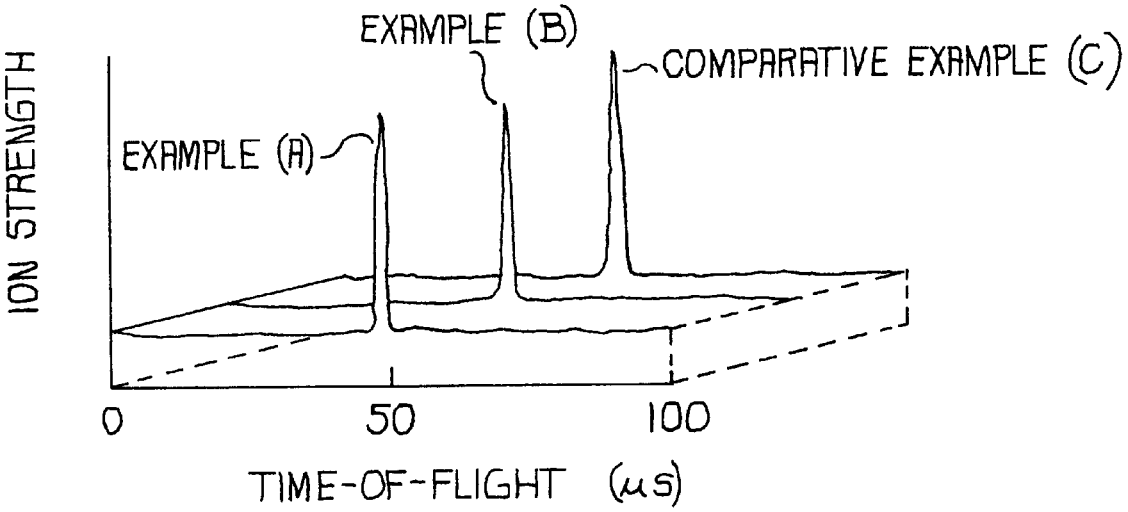
FIG. 16 is a graph showing the mass spectra of chlorobenzene obtained by using the apparatus of FIG. 13.

It can be seen from FIG. 16 that signal strength was very small, even using the slit skimmer. It is apparent that, by using the slit skimmer, in principle, molecules in the peripheral portions of the molecular jet, i.e. excess molecules which do not contribute to signals, are stopped and do not enter the ionization chamber and the mass spectrometer. Accordingly, the results indicate that, by adding the slit skimmer, variation of vacuum degree of the mass spectrometer is inhibited, and the vacuum degree, in the case of introducing the same amount of sample, is improved without degrading the sensitivity. This matter means that, if the vacuum degree of a mass spectrometer is kept at the same level irrespective of the presence of a slit skimmer, the addition of a slit skimmer can achieve a higher sensitivity by introducing a large amount of sample with a uniform flow of molecules which contributes to the signal.

As can be seen from the comparison of Example 5 with Comparative Example 6, according to the invention, since a large amount of sample can be introduced without raising the capacity of the mass spectrometer, i.e. by using an inexpensive compact mass spectrometer, the improvement in sensitivity can be achieved while keeping a laser ionization mass spectrometer compact.

Industrial Field of Utilization

As mentioned heretofore, in the laser ionization mass spectrometric apparatus and the mass spectrometric method of the invention, the ionization efficiency is improved by the irradiation of an ultrashort pulsed laser beam having a great peak output, but extreme fragmentation does not occur because the irradiation energy does not become great due to the short irradiation time. Accordingly, a high sensitivity detection is possible, and the lower limit of determination (detection) can be lowered. Since background noise caused by oil or a residual sample can be reduced due to the shortening of the sample introduction time and using an oil-free pump for the exhaust of the ionization chamber, high sensitivity detection is possible and the determination (detection) lower limit can be lowered. Furthermore, since a large amount of sample can be introduced by an inexpensive compact mass spectrometer, an improvement in sensitivity can be achieved while keeping the laser ionization mass spectrometer compact. Accordingly, the apparatus and method of the invention are suitable for rapid analysis of various compounds, such as nitrogen oxides, sulfur oxides, aromatic compounds, chlorine-containing organic compounds, chlorinated aromatic compounds and other halogen-containing compounds contained in combustion exhaust gases of coal, heavy oil, etc., combustion exhaust gases of municipal waste or industrial waste, gases generated by the pyrolysis of plastics and so on.

We claim:

1. A laser ionization mass spectrometric apparatus comprising a sample introducing portion provided with a pulse valve which forms a molecular jet, a pulsed laser beam oscillator, a vacuum ionization chamber or a corresponding portion thereto having a window capable of passing the laser beam radiated from the oscillator, and a mass spectrometer which analyzes the mass of molecules ionized by the laser beam, wherein said pulse laser oscillator has an ability of oscillating an ultrashort pulsed laser beam having a peak output of 1 MW or more.

2. The laser ionization mass spectrometric apparatus as set forth in claim 1, wherein a turbo-molecular vacuum pump is used as a pump which evacuates said vacuum ionization chamber.

3. A mass spectrometry method which comprises forming a pulsed molecular jet by injecting a sample gas through a pulse valve capable of forming a molecular jet into a vacuum ionization chamber or a corresponding portion thereto, irradiating an ultrashort pulsed laser beam having a peak output of 1 MW or more onto the molecular jet to ionize it, and analyzing the mass of molecules ionized by the laser beam.

4. The mass spectrometry method as set forth in claim 3, wherein the energy of the pulsed laser beam is 5 mJ or less, and irradiation time is three times to $1/10000$ time as long as the excitation life of a molecule to be measured.

5. A laser ionization mass spectrometric apparatus comprising a sample introducing portion provided with a pulse valve which forms a molecular jet, a pulsed laser beam oscillator, a vacuum ionization chamber or a corresponding portion thereto having a window capable of passing the laser beam radiated from the oscillator, and a mass spectrometer which analyzes the mass of molecules ionized by the laser beam, wherein a turbo-molecular vacuum pump is used as a pump which evacuates said vacuum ionization chamber.

6. A laser ionization mass spectrometric apparatus comprising a sample introducing portion provided with a nozzle which forms a molecular jet, a pulsed laser beam oscillator, a vacuum ionization chamber or a corresponding portion thereto having a window capable of passing the laser beam radiated from the oscillator, and a mass spectrometer which analyzes the mass of molecules ionized by the laser beam, wherein said nozzle of the sample introducing portion comprises two or more pinhole nozzles.

7. A laser ionization mass spectrometric apparatus comprising a sample introducing portion provided with a slit nozzle which forms a molecular jet, a pulsed laser beam oscillator, a vacuum ionization chamber or a corresponding portion thereto having a window capable of passing the laser beam radiated from the oscillator, and a mass spectrometer which analyzes the mass of molecules ionized by the laser beam, wherein said slit nozzle is partitioned from the vacuum ionization chamber by a slit skimmer which inhibits a stream of molecules on the periphery of the molecular jet from entering the vacuum ionization chamber.

* * * * *